US008256184B2

(12) United States Patent
Lowe

(10) Patent No.: US 8,256,184 B2
(45) Date of Patent: Sep. 4, 2012

(54) PROTECTIVE COVERING FOR WOODEN UTILITY POLES AND METHOD OF INSTALLATION

(76) Inventor: Harry Lowe, Nanaimo (CA)

( * ) Notice: Subject to any disclaimer, the term of this patent is extended or adjusted under 35 U.S.C. 154(b) by 225 days.

(21) Appl. No.: 12/556,549

(22) Filed: Sep. 9, 2009

(65) Prior Publication Data

US 2011/0056170 A1 Mar. 10, 2011

(51) Int. Cl.
*E04H 12/22* (2006.01)
*E04H 9/14* (2006.01)

(52) U.S. Cl. ..... 52/741.3; 52/834; 52/170; 52/741.4; 52/835

(58) Field of Classification Search ..... 52/835, 52/741.3, 741.4, 170, 169.14, 745.17, 741.14, 52/741.11
See application file for complete search history.

(56) References Cited

U.S. PATENT DOCUMENTS 1,521,285 A * 12/1924 Erickson ..... 52/170
3,372,552 A * 3/1968 Liddell ..... 405/215
3,562,403 A * 2/1971 Monahan et al. ..... 174/45 R
3,607,516 A * 9/1971 Royston ..... 156/187
4,268,992 A * 5/1981 Scharf, Sr. ..... 47/32.4
5,138,806 A * 8/1992 Marx et al. ..... 52/170
5,311,713 A * 5/1994 Goodrich ..... 52/301
5,326,410 A * 7/1994 Boyles ..... 156/71
5,516,236 A * 5/1996 Williams et al. ..... 405/216
2002/0098311 A1* 7/2002 Lindner ..... 428/40.1
2003/0221390 A1* 12/2003 Docter ..... 52/736.4
2006/0088386 A1* 4/2006 Ellis ..... 405/211.1

* cited by examiner

*Primary Examiner* — William Gilbert
*Assistant Examiner* — Beth Stephan
(74) *Attorney, Agent, or Firm* — Gordon Thomson

(57) ABSTRACT

A protective cover for a wooden utility pole comprises a polymer envelope in which the bottom of the pole is placed. The envelope is sufficiently dimensioned to cover about 10 feet of the bottom of the pole. The envelope body is wrapped around the bottom portion of the pole and PVC tape is used to secure the body to the pole. A hermetic seal is placed over the mouth of the envelope which is located above the grade level of the excavation in which the pole sits thereby sealing the envelope to the pole. A metallic band is placed around the seal to protect it.

2 Claims, 7 Drawing Sheets

PROTECTIVE COVERING FOR WOODEN UTILITY POLES AND METHOD OF INSTALLATION

FIELD OF THE INVENTION

This invention relates to the field of preserving wooden structures using fabrics and other coverings. In particular this invention relates to a protective covering for wooden utility poles and a method of installation of the protective covering.

BACKGROUND OF THE INVENTION

Wooden utility poles remain in wide use throughout the world because they are easily obtainable and easy to work with. However, wooden poles have deficiencies that continue to reduce their life span. They can be easily degraded when placed into the earth by fungus, insects and moisture. As well, wooden poles are often treated and impregnated with highly toxic chemicals such as creosote, copper, zinc, arsenate and PCB derivatives that have deleterious effects on the environment. These chemicals can leach into the surrounding water table and pollute it. To overcome these deficiencies, numerous types of pole boots and coverings have been tried. For example, U.S. Pat. No. 6,237,305 "Process for In-Situ Treatment of Wood Poles" issued to Landers on May 28, 2001 discloses a treatment for wooden poles whereby the use of toxic chemicals is continued. Holes are drilled into the pole which may compromise the structural stability of the pole. In U.S. Pat. No. 7,409,798 "Device for Protecting Objects from Encroaching Elements" issued to Freeby on Aug. 12, 2008 there is described a device which comprises disbursing a bentonite material around the base of the utility pole. The device and method is most likely expensive as it requires the excavation of a large hole in which to place the material and containment barrier.

Therefore, there continues to be a need for a device and method for protecting wooden poles which is easy to use in-situ, is inexpensive to apply and results in a significantly prolonged life for the wooden pole.

SUMMARY OF THE INVENTION

To overcome the deficiencies noted above, my invention provides for a protective covering for a wooden utility pole comprising a water impermeable membrane for placement around a bottom portion of a wooden utility pole; means for securing the water impermeable membrane tightly to the bottom portion of the wooden utility pole; means for creating a hermetical seal for sealing the water impermeable membrane around the wooden utility pole; and, means for protecting the hermitical seal against physical damage.

In a preferred embodiment of the invention the membrane is a polyvinylchloride envelope having top-end mouth for receiving the bottom portion of the wooden utility pole and a body sufficiently dimensioned to enclose the bottom portion of the wooden utility pole.

In a preferred embodiment of the invention the envelope has a thickness of between 6 mm and 20 mm.

In one embodiment of the invention PVC tape is used to fix the envelope around the pole.

The top of the envelope is then sealed using PVC tape over which a length of mastic is placed.

In a preferred embodiment of the invention, an aluminum band is placed around the mastic.

OBJECTS AND ADVANTAGES OF THE INVENTION

It is one objective of the present invention to extend the life of wooden utility poles thereby saving money.

It is another object of the present invention to prevent toxic wood preservatives from leaching from the utility pole into the water table by encapsulating them within an impermeable envelope.

Another object of the present invention is to provide a device and method for fast and easy installation of a protective cover onsite thereby saving material and labour costs.

DETAILED DESCRIPTION OF EXAMPLES OF PREFERRED EMBODIMENTS OF THE INVENTION

Figure 1:
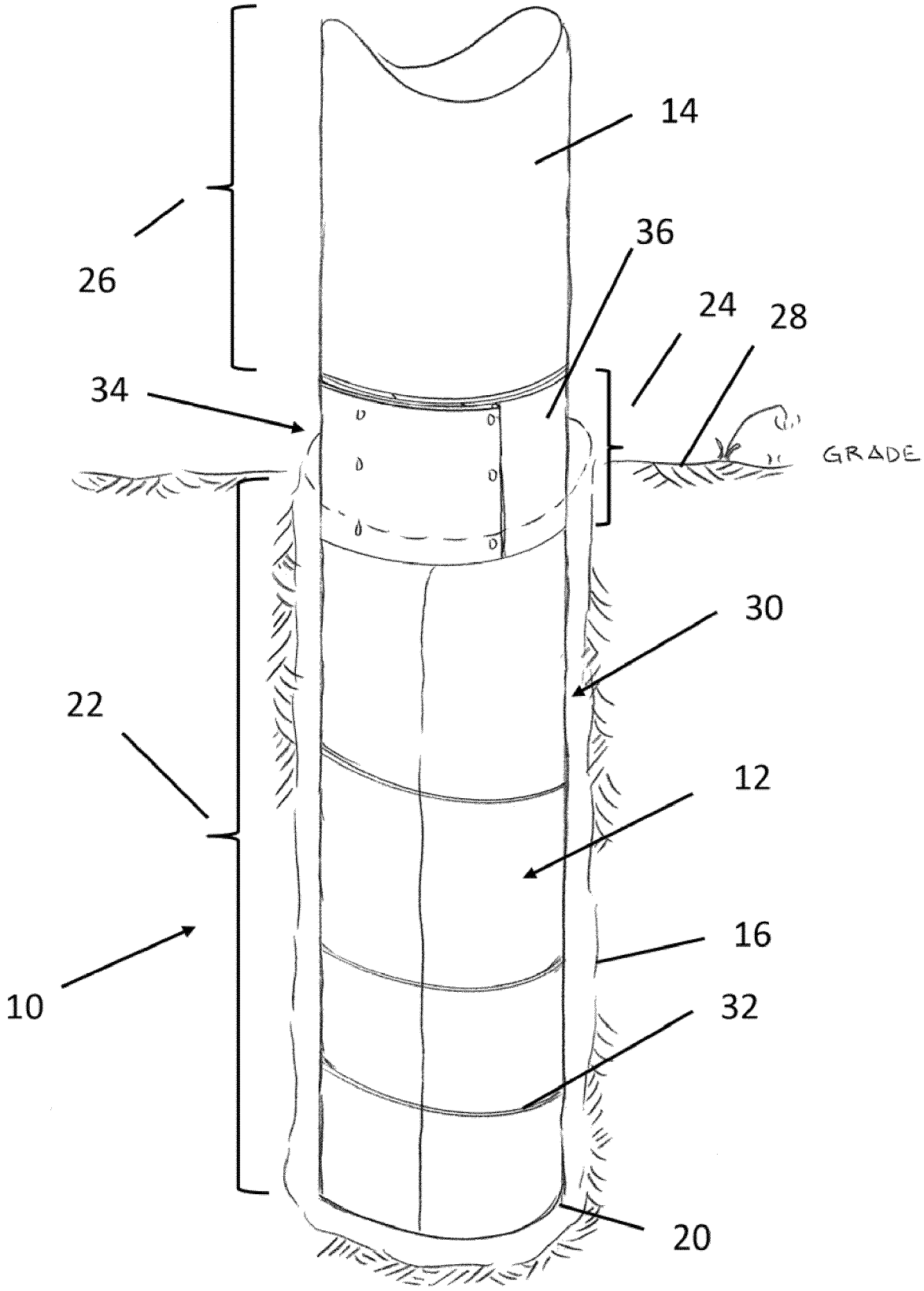
FIG. 1 is a view of one embodiment of the invention showing the bottom portion of a wooden utility pole in a cross-section of an excavation.

Referring to FIG. 1 there is shown one embodiment of my invention 10 which is a protective covering 12 for a wooden utility pole 14. In this figure, the pole is shown in an excavation in cross-section 16. The pole 14 is generally about 40 feet long. The bottom width of the pole is about 27 inches and the pole tapers slightly to the top of the pole. Typically about 5 feet to 7 feet of the pole are buried. In the embodiment shown, the pole has a bottom surface 20, a bottom buried portion 22, a grade portion 24 and a top portion 26. The grade portion 24 is intended to sit above and below grade level 28. The invention 10 comprises a water impermeable membrane 30 for placement around the bottom portion 22 of the wooden utility pole 14, means 32 for securing the water impermeable membrane 30 tightly to the bottom portion 22 of the wooden utility pole 14; means for creating a hermetical seal 34 for sealing the water impermeable membrane around the wooden utility pole; and, means 36 for protecting the hermitical seal against physical damage caused by backfilling or impact from objects, snow, ice and other anticipated hazards.

Figure 2:
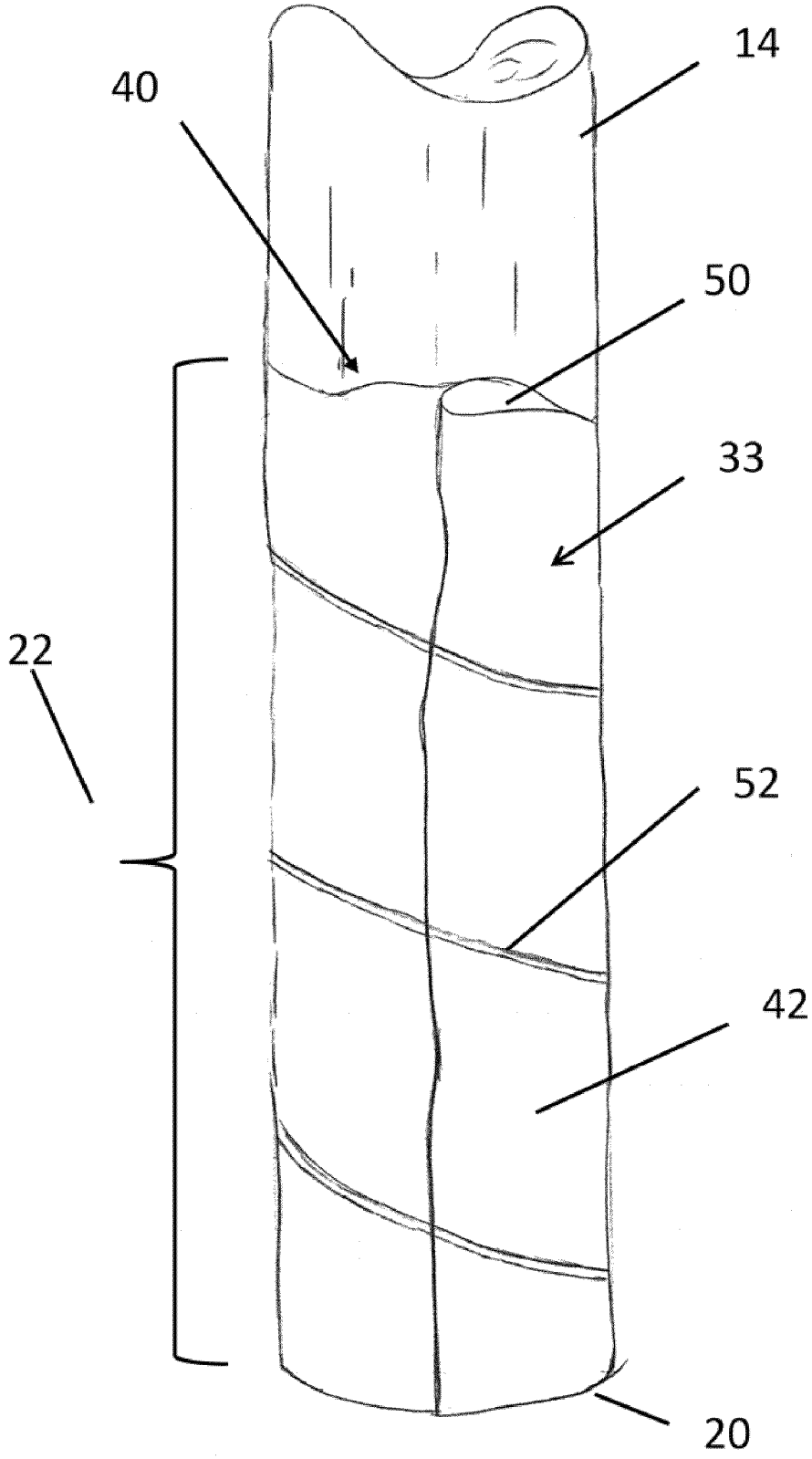
FIG. 2 is a view of one embodiment of the invention showing the polymer enveloped wrapped around the bottom section of the pole.

Referring to FIG. 2, and in a preferred embodiment of the invention the water impermeable membrane 30 comprises a polymer envelope 33 having a top-end mouth 40 for receiving the bottom portion 22 of the wooden utility pole 14 and a body 42 sufficiently dimensioned to enclose the bottom portion of the wooden utility pole when placed in the excavation 16. In one embodiment of the invention the polymer envelope 33 is made from a suitable polyvinylchloride material that is between 6 mm and 20 mm thick.

The polymer envelope 33 is wrapped around the utility pole 14 so that any excess material in the envelope body 42 is wrapped around the pole as illustrated by loop 50. A first length of tape 52, generally PVC tape, is wrapped around the envelope 33 in a helical manner from the bottom surface 20 to the top of the bottom portion 22 of the wooden pole thereby securing the envelope tightly to the bottom portion of the pole.

Figure 3:
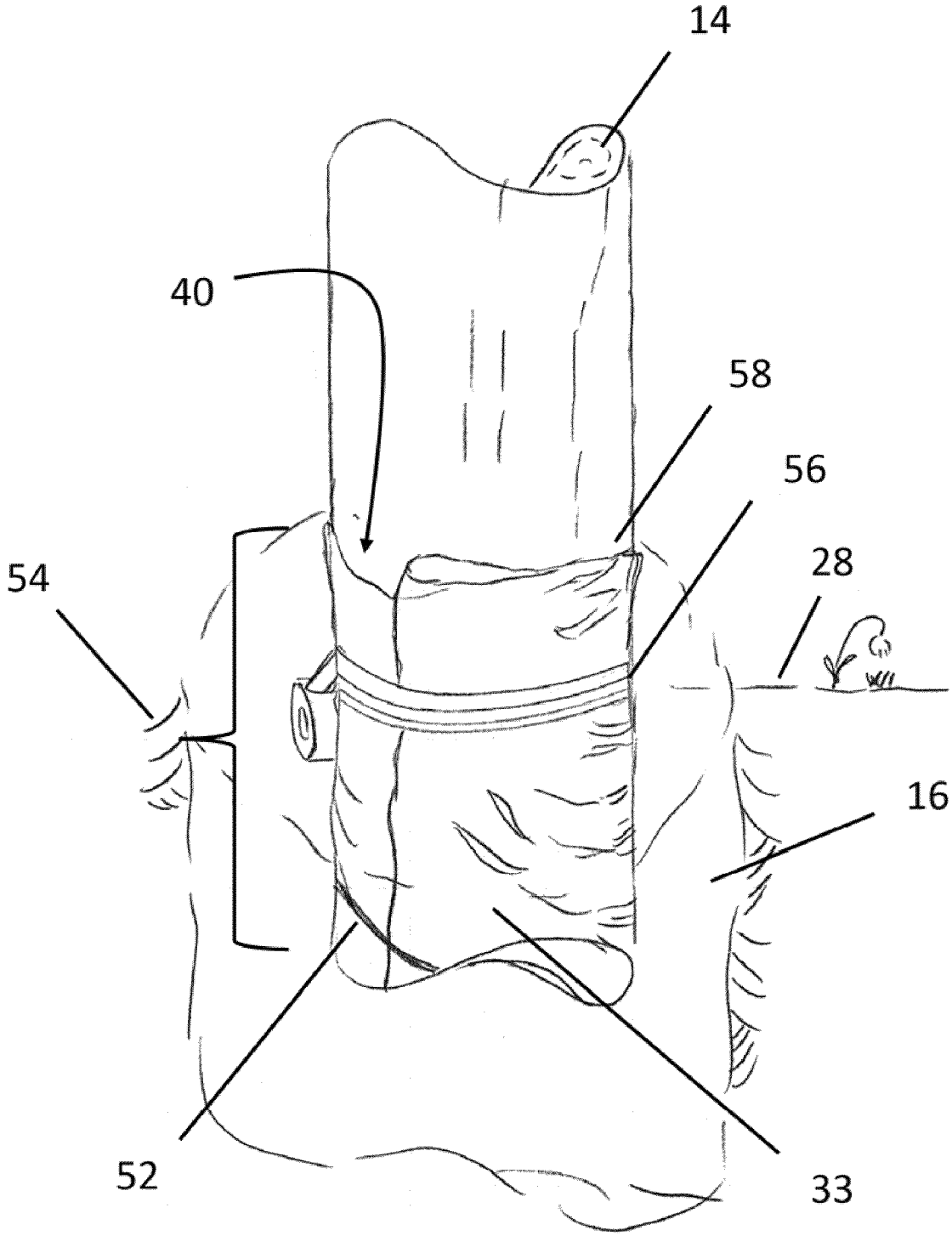
FIG. 3 is a view of a centre portion of one embodiment of the invention showing the top of the enveloped above grade.

Referring now to FIG. 3, there is shown a central portion 54 of the wooden pole 14 with top and bottom portions truncated for this view. The pole 14 sits in excavation 16. The polymer envelope 33 has been placed over the bottom portion 20 of the pole and excess material wrapped around the pole and adhered to the pole by a first length of PVC tape 52. The top end 58 of the envelope 33 terminates above grade level 28. At grade level a second length of adhesive PVC tape 56 is used to wrap around the envelope just below the mouth 40 of the envelope 33 and secure it in place.

Figure 4:
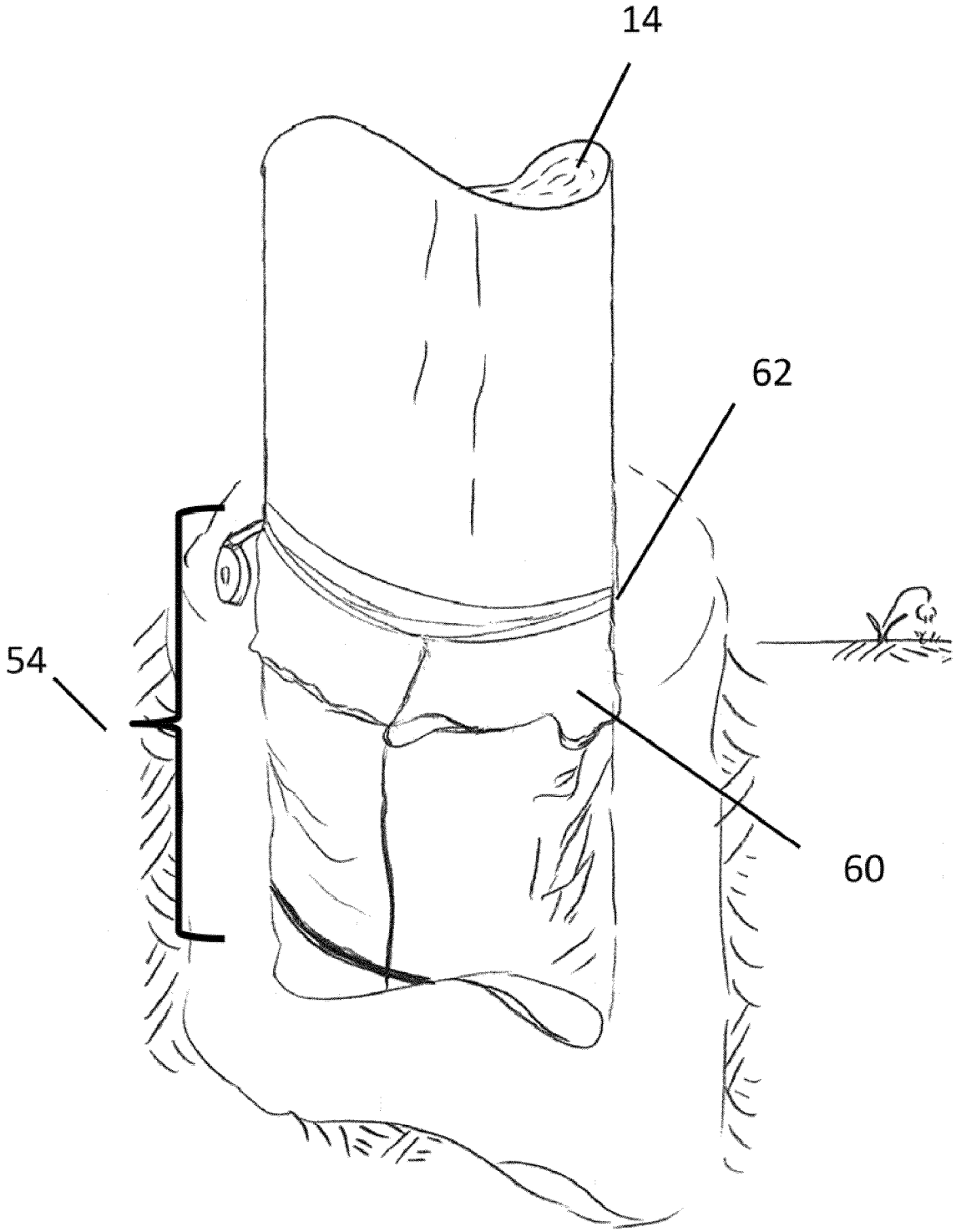
FIG. 4 is the same view as FIG. 3 showing the top end of the envelope folded over the tape and then taped again.

Referring now to FIG. 4, there is shown the same central portion 54 as illustrated in FIG. 3. The excess amount of polymer envelope material 60 is folded down over the second length of adhesive PVC tape and a third length of adhesive PVC tape 62 is used to secure the fold in place. Any excess envelope material 60 below the tape line 62 is trimmed from the pole.

Figure 5:
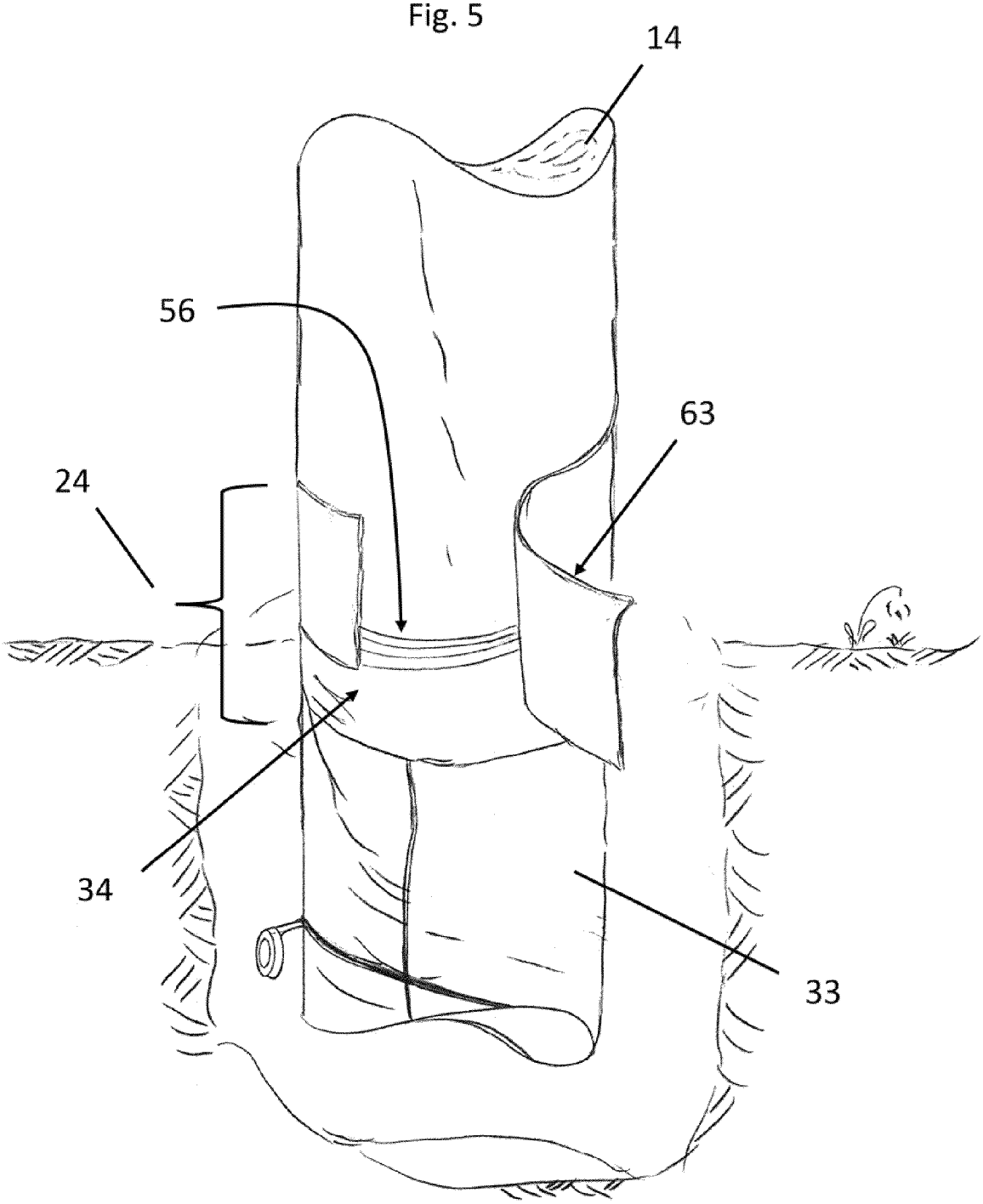
FIG. 5 is the same view as FIG. 3 and FIG. 4 showing the application of the mastic.
Figure 6:
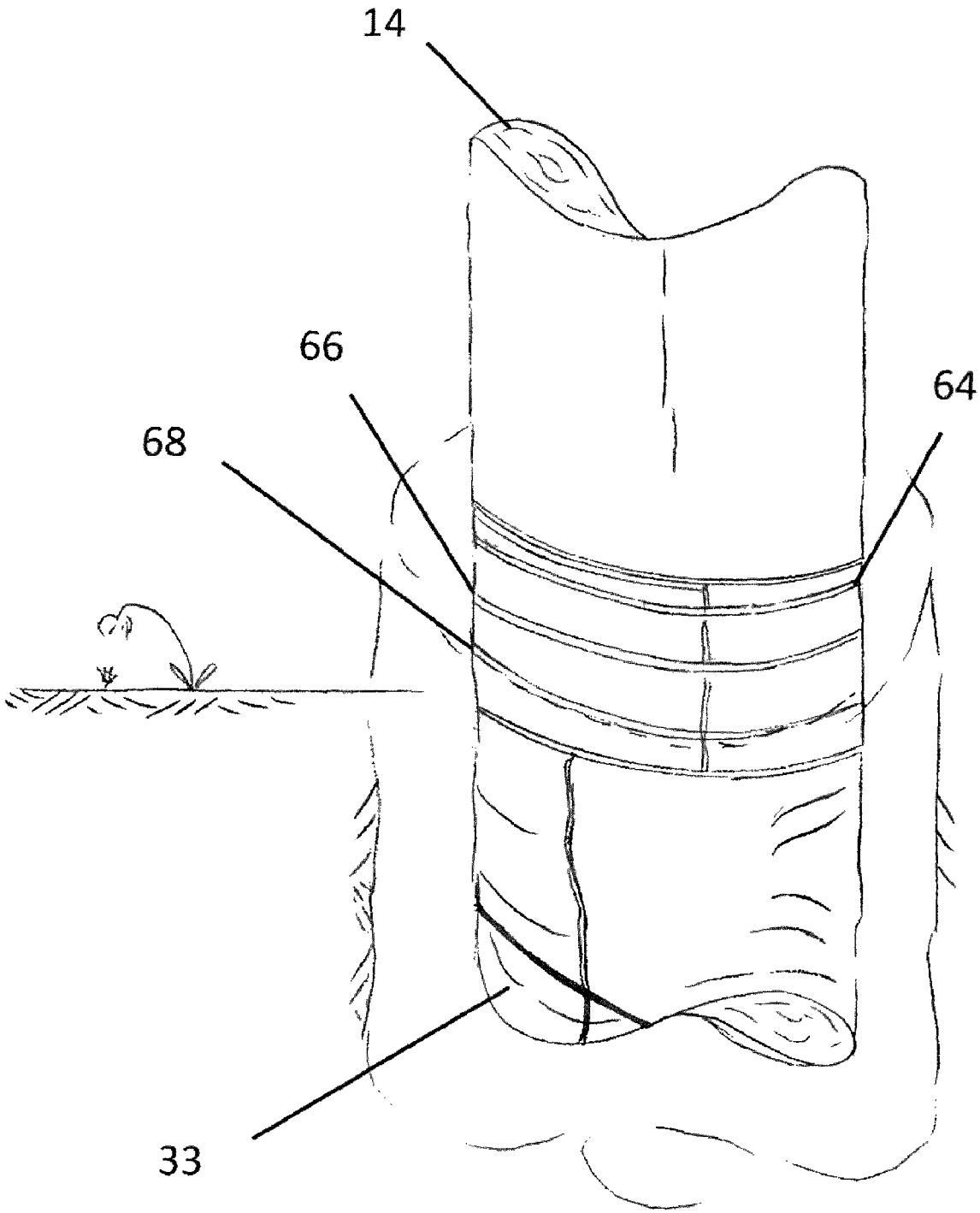
FIG. 6 is the same view as FIG. 5 showing the taping of the mastic.

Referring now to FIG. 5, there is shown means for creating a hermetical seal 34 for sealing the envelope 33 around the wooden utility pole 14. Means 34 comprises a length of self-adhesive polymer material 63 placed around the top edge 56 of the envelope 33 and the grade portion 24 of the wooden utility pole 14. In a preferred embodiment of the invention the length of self-adhesive polymer material comprises mastic. Once the mastic is in place, it is secured by a fourth 64, fifth 66 and sixth 68 lengths of adhesive PVC tape. This is illustrated in FIG. 6.

Figure 7:
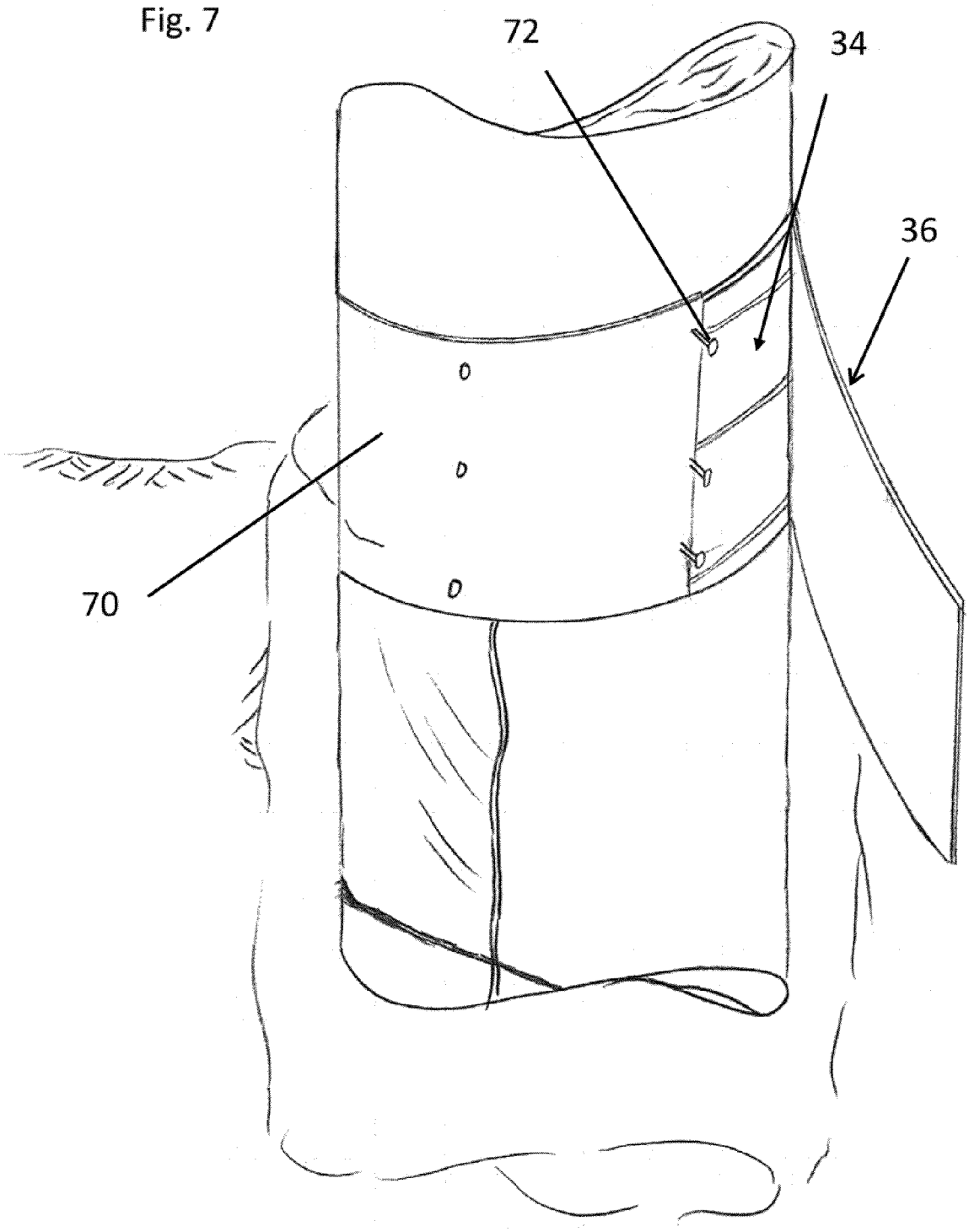
FIG. 7 is the same view as FIG. 6 showing the application of the metallic band around the mastic.

Referring now to FIG. 7, there is one an embodiment of the invention in which means for protecting 36 the hermitical seal against physical damage comprises a metallic strip 70 for placement over the hermitical seal 34 and dimensioned to overlap the hermitical seal by about one to three inches top and bottom. The means 36 is a metallic strap or band comprising generally aluminum and nailed to the utility pole using aluminum nails 72. As a rain shield, the top edge of the aluminum band can be caulked with a malleable butyl compound, for water sealing. The compound is able to adjust to the expansion and shrinkage of the pole over time. Preferably the compound is resistant to ultra-violet light.

The invention is intended to be used in-situ. That is, the pole is transported to the site of the installation and the protective covering is installed on the pole. However, the pole can be combined with a protective covering for a wooden utility pole away from the site and then transported to the site. Referring to the drawings, such an embodiment would comprise a wooden pole 14 for placement in an excavation 16 and a protective covering 33. The wooden utility pole has a bottom surface 20, a bottom portion 22, a grade section 24 and a top section 26. The wooden utility pole is adapted for bottom portion placement within the excavation up to the grade section of the pole. The protective covering 33 comprises a water impermeable polymer envelope having a mouth 40 for inserting the bottom surface of the wooden utility pole and a body 42 sufficiently dimensioned to enclose the bottom portion from the bottom surface to the grade section. A first length of adhesive PVC tape 52 is used for tight helical wrapping around the envelope from the bottom portion of the wooden utility pole to the grade section of the wooden utility pole. A hermetical seal 34 is disposed around the mouth of the envelope within the grade section so that the hermetical seal is equidistant above and below the grade. An aluminum strip 70 is placed around the hermetical seal for protecting it against physical damage. The polymer envelope is comprised of polyvinylchloride having a thickness between 6 mm and 20 mm. The hermetical seal comprises a length of self-adhesive mastic 63 for placement around a top edge of the envelope and the wooden utility pole within the grade section and a second length of adhesive PVC tape for wrapping around the length of self-adhesive mastic.

The invention also teaches a method of installing a protective covering on a wooden utility pole for placement in an adjacent excavation below grade level. The wooden utility pole has a bottom surface, a bottom portion, a grade section and a top section. The adjacent excavation is sufficiently deep to accept the wooden utility pole so that the bottom surface rests at the bottom of the excavation and the grade section rests at grade level. The method comprises the steps of:

a. Placing the wooden utility pole on blocks proximate to the excavation so that the bottom surface and the bottom portion are accessible and disposed towards the excavation;
b. Procuring a water impermeable polymer envelope having a mouth for inserting the bottom surface of the wooden utility pole and a body sufficiently dimensioned to enclose the bottom portion from the bottom surface to the grade section;
c. Inserting the bottom surface of the wooden utility pole into the envelope mouth and pulling the envelope body upwards over the wooden utility pole so that the mouth of the envelope is disposed above the grade section;
d. Wrapping the envelope body around the bottom portion of the wooden utility pole and fixing the envelope body in place using a first length of adhesive pvc tape wrapped helically above the grade section down to where the mouth of the envelope is disposed within the grade section;
e. Placing the covered utility pole bottom portion in the excavation so that the grade section is at grade level;
f. Backfilling the excavation to within 12 inches of grade level thereby forcing air out of the envelope;
g. Wrapping a second length of adhesive pvc tape around the envelop body at a first location on the bottom portion of the wooden utility pole that is about 2 inches above the grade level of the excavation;
h. Folding the mouth of the envelope back down to a second location about 6 inches below the first location and within the grade portion of the wooden utility pole;
i. Using a third length of adhesive pvc tape, securely wrap the mouth of the envelope at the second location so that the third length of pvc adhesive tape contacts both the wooden utility pole and the envelope;
j. Applying a self-adhesive mastic seal around the mouth of the envelope so that the mastic seal adheres to approximately 4 inches of the wooden utility pole and about 2 inches of the envelope thereby creating a hermitic seal;
k. Applying a fourth, fifth and sixth lengths of adhesive pvc tape around the top, middle and bottom of the mastic seal;
l. Applying an aluminum strip over the mastic seal so that the aluminum strip overlaps the mastic seal by about 1 to 3 inches top and bottom; and,
m. Backfilling the excavation to the grade level.

Therefore, it can be readily understood that my invention extends the life of wooden utility poles by encasing the bottom portion thereof in an impermeable envelope so as to prevent the elements from degrading the pole. This saves utility companies a considerable amount of money. Furthermore, my invention prevents toxic wood preservatives from leaching from the utility pole into the water table by encapsulating them within an impermeable envelope. As well, my invention may render unnecessary the application of chemical preservatives and fungicides to a pole since it is no longer in ground contact. My invention provides a device and method for fast and easy installation of a protective cover onsite thereby saving material and labour costs.

Although the description above contains much specificity, these should not be construed as limiting the scope of the invention but as merely providing illustrations of the presently preferred embodiment of this invention. Thus the scope of the invention should be determined by the appended claims and their legal equivalents.

What is claimed is:

1. A protective covering installed on a pole comprising a diameter, a bottom surface and a buried portion, said protective covering comprising:

a. A water impermeable polymer envelope having a width, an open mouth along a top end, a sealed bottom end, a left sealed side and a right sealed side, wherein said open mouth receives said pole bottom surface and wherein said envelope encloses said pole buried portion, and further wherein said width of the open mouth is wider than said pole diameter so that said left sealed side and said right sealed side comprise excess envelope material;

b. A first length of adhesive pvc tape wrapped tightly and helically around said water impermeable polymer envelope from a bottom portion of the envelope to a top edge of the envelope so that said excess envelope material is wrapped around the buried portion;

c. A length of sell-adhesive mastic which is placed above grade around said top edge of the water impermeable polymer envelope thereby creating a hermetical seal for sealing the top edge of the water impermeable polymer envelope around the pole;

d. A covering placement of a second length of pvc tape which is placed over said length of self-adhesive mastic; and, e. A metallic strip which is fixed over the hermitical seal and dimensioned to overlap the top and bottom of the hermitical seal for protecting the hermitical seal against physical damage.

2. A method of installing a protective covering on a pole for placement in an adjacent excavation below grade level, said pole having a bottom surface, a bottom portion, a grade section a diameter and a top section, and wherein said adjacent excavation is sufficiently deep to accept the pole so that said bottom surface rests at the bottom of the excavation and said grade section rests within said grade section; and wherein said method comprising the steps of:

b. Providing a water impermeable polymer envelope having a width, an open mouth along a top end, a sealed bottom end, a left sealed side and a right sealed side, the width of the open mouth is wider than the pole diameter so that said left sealed side and said right sealed side comprise excess material;

c. Inserting the bottom surface of the pole into said envelope mouth and pulling said envelope body upwards over the pole so that the mouth of the envelope is disposed above the grade section;

d. Wrapping the envelope body excess material around the bottom portion of the pole and fixing the envelope body in place using a first length of adhesive pvc tape wrapped helically above the grade section down to where the mouth of the envelope is disposed within the grade section;

e. Placing the pole bottom portion in the excavation so that the grade section is at grade level;

f. Back filling the excavation to within 12 inches of grade level thereby forcing air out of the envelope;

g. Wrapping a second length of adhesive pvc tape around the envelop at a first location on the bottom portion of the pole that is about 2 inches above the grade level of the excavation;

h. Folding the mouth of the envelope back down to a second location about 6 inches below said first location and within the grade portion of the pole;

i. securely wrapping a third length of adhesive pvc tape around the mouth of the envelope at said second location so that said third length of adhesive pvc tape contacts both the pole and the envelope;

j. Applying a self-adhesive mastic seal around the mouth of the envelope so that the mastic seal adheres to approximately 4 inches of the wooden utility pole and about 2 inches of the envelope thereby creating a hermitic seal;

k. Applying a fourth, fifth and sixth lengths of adhesive pvc tape around the top, middle and bottom of the mastic seal;

l. Applying an aluminum strip over the mastic seal so that said aluminum strip overlaps the mastic seal by about 1 to 3 inches; and, m. Backfilling the excavation to the grade level.

* * * * *